US007255417B2

(12) United States Patent
Yamazaki et al.

(10) Patent No.: US 7,255,417 B2
(45) Date of Patent: Aug. 14, 2007

(54) CALIBRATION OF INK EJECTION AMOUNT FOR A PRINTER

(75) Inventors: Satoshi Yamazaki, Nagano-ken (JP); Toshiaki Kakutani, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 373 days.

(21) Appl. No.: 11/040,803

(22) Filed: Jan. 20, 2005

(65) Prior Publication Data

US 2005/0185005 A1 Aug. 25, 2005

(30) Foreign Application Priority Data

Jan. 22, 2004 (JP) ..... 2004-014026

(51) Int. Cl.
*B41J 29/393* (2006.01)
*B41J 29/38* (2006.01)

(52) U.S. Cl. ..... 347/19; 347/6

(58) Field of Classification Search ..... 347/19, 347/6

See application file for complete search history.

(56) References Cited

U.S. PATENT DOCUMENTS

| | | | | |
|---|---|---|---|---|
| 6,382,757 | B1 * | 5/2002 | Kakutani | 347/43 |
| 2002/0018088 | A1 | 2/2002 | Takahasi et al. | |
| 2004/0017415 | A1 * | 1/2004 | Nunokawa | 347/15 |

FOREIGN PATENT DOCUMENTS

| | | |
|---|---|---|
| EP | 0 854 039 | 7/1998 |
| JP | 05-162338 | 6/1993 |
| JP | 10-000795 | 1/1998 |
| JP | 10-323978 | 12/1998 |
| JP | 2003-291376 | 10/2003 |

OTHER PUBLICATIONS

Abstract of Japanese Patent Publication No. 2003-291376, Pub. Date: Oct. 14, 2003, Patent Abstracts of Japan.

Abstract of Japanese Patent Publication No. 05-162338, Pub. Date: Jun. 29, 1993, Patent Abstracts of Japan.

Abstract of Japanese Patent Publication No. 10-000795, Pub. Date: Jan. 6, 1998, Patent Abstracts of Japan.

Abstract of Japanese Patent Publication No. 10-323978, Pub. Date: Dec. 8, 1998, Patent Abstracts of Japan.

* cited by examiner

*Primary Examiner*—Matthew Luu
*Assistant Examiner*—Jannelle M. Lebrón
(74) *Attorney, Agent, or Firm*—Martine Penilla & Gencarella, LLP

(57) ABSTRACT

An ink ejection amount error is acquired for each of a plurality of same ink nozzle arrays for ejecting same ink. Line sets consisting of N adjacent main scan lines are classified into a plurality of line set types LT11 to LT13 according to a ratio of the pixel counts allocated to the plurality of nozzle arrays on the line set. Using the ink ejection amount error of each nozzle array, the average ink ejection error δ is obtained for each of the line set types LT11 to LT13. The ink amount data on each main scan line of each line set is corrected using the average ink ejection amount error for each line set.

9 Claims, 15 Drawing Sheets

STRUCTURE OF PRINT DATA GENERATION UNIT 250 (FIRST EMBODIMENT)

Fig.4A

Pixel allocation ratio for 1-line-set types LT11 to LT13

| | A | B | C |
|---|---|---|---|
| LT11 | 2 | 1 | 1 |
| LT12 | 1 | 2 | 1 |
| LT13 | 1 | 1 | 2 |

Fig.4B

Head allocation for each pixel

| | 1 | 2 | 3 | 4 | 5 | 6 | 7 | 8 | |
|---|---|---|---|---|---|---|---|---|---|
| L1 | C | A | B | A | C | A | B | A | ··· |
| L2 | A | B | C | B | A | B | C | B | ··· |
| L3 | B | C | A | C | B | C | A | C | ··· |
| L4 | C | A | B | A | C | A | B | A | ··· |
| L5 | A | B | C | B | A | B | C | B | ··· |
| L6 | B | C | A | C | B | C | A | C | ··· |
| L7 | C | A | B | A | C | A | B | A | ··· |
| L8 | A | B | C | B | A | B | C | B | ··· |
| L9 | B | C | A | C | B | C | A | C | ··· |
| L10 | C | A | B | A | C | A | B | A | ··· |
| L11 | A | B | C | B | A | B | C | B | ··· |
| L12 | B | C | A | C | B | C | A | C | ··· |

Fig.5A

Pixel allocation ratio for 2-line-set types LT21 to LT26

| | A | B | C |
|---|---|---|---|
| LT21 | 3 | 3 | 2 |
| LT22 | 3 | 2 | 3 |
| LT23 | 2 | 3 | 3 |
| LT24 | 4 | 2 | 2 |
| LT25 | 2 | 4 | 2 |
| LT26 | 2 | 2 | 4 |

Fig.5B

Head allocation for each pixel

| | 1 | 2 | 3 | 4 | 5 | 6 | 7 | 8 | |
|---|---|---|---|---|---|---|---|---|---|
| L1 | C | A | B | A | C | A | B | A | ··· |
| L2 | A | B | C | B | A | B | C | B | ··· |
| L3 | B | C | A | C | B | C | A | C | ··· |
| L4 | C | A | B | A | C | A | B | A | ··· |
| L5 | A | B | C | B | A | B | C | B | ··· |
| L6 | B | C | A | C | B | C | A | C | ··· |
| L7 | C | A | B | A | C | A | B | A | ··· |
| L8 | A | B | C | B | A | B | C | B | ··· |
| L9 | B | C | A | C | B | C | A | C | ··· |
| L10 | C | A | B | A | C | A | B | A | ··· |
| L11 | A | B | C | B | A | B | C | B | ··· |
| L12 | B | C | A | C | B | C | A | C | ··· |

Fig.6A

Pixel allocation ratio for 4-line-set types LT41 to LT43

| | A | B | C |
|---|---|---|---|
| LT41 | 6 | 5 | 5 |
| LT42 | 5 | 6 | 5 |
| LT43 | 5 | 5 | 6 |

Fig.6B

Head allocation for each pixel

| | 1 | 2 | 3 | 4 | 5 | 6 | 7 | 8 | |
|---|---|---|---|---|---|---|---|---|---|
| L1 | C | A | B | A | C | A | B | A | ··· |
| L2 | A | B | C | B | A | B | C | B | ··· |
| L3 | B | C | A | C | B | C | A | C | ··· |
| L4 | C | A | B | A | C | A | B | A | ··· |
| L5 | A | B | C | B | A | B | C | B | ··· |
| L6 | B | C | A | C | B | C | A | C | ··· |
| L7 | C | A | B | A | C | A | B | A | ··· |
| L8 | A | B | C | B | A | B | C | B | ··· |
| L9 | B | C | A | C | B | C | A | C | ··· |
| L10 | C | A | B | A | C | A | B | A | ··· |
| L11 | A | B | C | B | A | B | C | B | ··· |
| L12 | B | C | A | C | B | C | A | C | ··· |

Fig.7A

Ink weight information W (%) of each head

| Head | Wc | Wm | Wy | Wk |
|---|---|---|---|---|
| 320A | 98 | 99 | 100 | 101 |
| 320B | 100 | 98 | 99 | 100 |
| 320C | 101 | 101 | 100 | 100 |

Fig.7B

Ink calibration value δ for each 1-line-set type

| | Pixel allocation ratio | | | Ink calibration value δ | | | |
|---|---|---|---|---|---|---|---|
| Type | A | B | C | δc | δm | δy | δk |
| LT11 | 2 | 1 | 1 | 99.25 | 99.25 | 99.75 | 100.50 |
| LT12 | 1 | 2 | 1 | 99.75 | 99.00 | 99.50 | 100.25 |
| LT13 | 1 | 1 | 2 | 100.00 | 99.75 | 99.75 | 100.25 |

Calibration value δc for types LT11 to LT13:

$$\delta c(LT11)=\{Wc(A)*2+Wc(B)+Wc(C)\}/4$$

$$\delta c(LT12)=\{Wc(A)+Wc(B)*2+Wc(C)\}/4$$

$$\delta c(LT13)=\{Wc(A)+Wc(B)+Wc(C)*2\}/4$$

Fig.10 STRUCTURE OF THE PRINT DATA GENERATION UNIT 250a (SECOND EMBODIMENT)
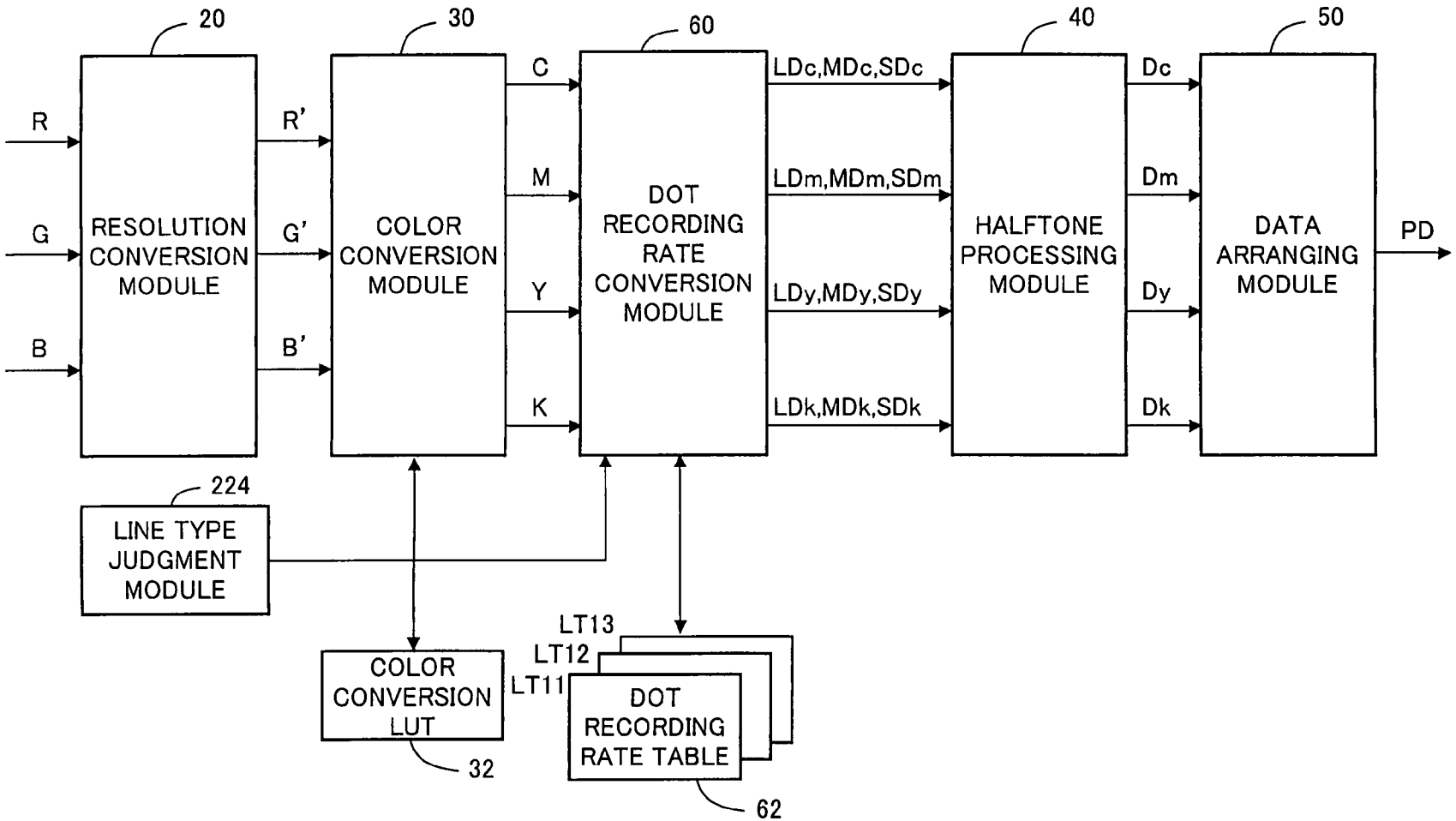

Initial dot recording rate table

Calibration of the dot recording rate table (second embodiment)

Fig.13A

Ink weight information W (%) of each head

| | Cyan Ink Weight Wc | | |
|---|---|---|---|
| Head | Wc(S) | Wc(M) | Wc(L) |
| 320A | 101 | 97 | 101 |
| 320B | 99 | 98 | 100 |
| 320C | 100 | 99 | 102 |

Fig.13B

Line calibration value δ for each 1-line-set type

| | Pixel allocation ratio | | | Cyan ink calibration value δ | | |
|---|---|---|---|---|---|---|
| Type | A | B | C | δ c(S) | δ c(M) | δ C(L) |
| LT11 | 2 | 1 | 1 | 100.25 | 97.75 | 101.00 |
| LT12 | 1 | 2 | 1 | 99.75 | 98.00 | 100.75 |
| LT13 | 1 | 1 | 2 | 100.00 | 98.25 | 101.25 |

Small dot calibration value δ c for type LT11 to LT13:

$$\delta c(S,LT11)=\{Wc(S,A)*2+Wc(S,B)+Wc(S,C)\}/4$$
$$\delta c(S,LT12)=\{Wc(S,A)+Wc(S,B)*2+Wc(S,C)\}/4$$
$$\delta c(S,LT13)=\{Wc(S,A)+Wc(S,B)+Wc(S,C)*2\}/4$$

Initial dot recording rate table

Calibration of the dot recording rate table (third embodiment)

Total ink amount Wt11 for line set type LT11:

$$Wt1 = \delta c(S,LT11) \times Wref(S) \times SD + \delta c(M,LT11) \times Wref(M) \times MD + \delta c(L,LT11) \times Wref(L) \times LD$$

CALIBRATION OF INK EJECTION AMOUNT FOR A PRINTER

CROSS-REFERENCE TO RELATED APPLICATIONS

The present application claims the priority based on Japanese Patent Application No. 2004-14026 filed on Jan. 22, 2004, the disclosure of which is hereby incorporated by reference in its entirety.

BACKGROUND OF THE INVENTION

1. Field of the Invention

The present invention relates to technology for calibrating ink ejection amount for a printer that forms ink dots on a printing medium while scanning a printing head unit in the main scan direction.

2. Description of the Related Art

Inkjet printers print images by ejecting ink from nozzles provided on a printing head. The same as with other types of printers, for inkjet printers as well, there is always a pursuit of improvements in quality and improvements in printing speed. In recent years, the inkjet printer image quality has improved at about the same level as silver salt photographs, so improvement of the printing speed is a bigger problem.

To improve printing speed, the easiest measure is to increase the number of nozzles per color. As a method of increasing the nozzle count, it is possible to use a plurality of printing heads, for example.

However, the ink ejection amount from a printing head nozzle ordinarily includes manufacturing errors. JP5-162338A and JP10-795A each describes a method of calibrating ink ejection amount that takes this kind of error into consideration.

With these methods, ink amount calibration is performed by calibrating the ejection amount with respect to each of the nozzles. However, sufficient mechanisms were not implemented for calibration of ink ejection amount for printers that have a plurality of printing heads. Also, this kind of problem is not limited to printers that use a plurality of printing heads, but generally is a problem that is common to printers that comprise a printing head unit that has a plurality of nozzle arrays for ejecting same ink (called a "same ink nozzle array").

SUMMARY OF THE INVENTION

An object of the present invention is to provide a technology that is able to perform calibration of ink ejection amount without requiring excessive work.

In an aspect of the present invention, there is provided a method of calibrating ink amount for a printer. The printer comprises a printing head unit that has a plurality of same ink nozzle arrays for ejecting same ink, and forms ink dots on a printing medium while scanning the printing head unit in the main scanning direction. The method comprises: (a) obtaining an ink ejection amount error for each of the plurality of the same ink nozzle arrays; (b) identifying line sets on the printing medium, each line set consisting of a predetermined number of main scan lines that are adjacent to each other; (c) allocating pixels included in each line set to the plurality of the same ink nozzle arrays for recording; (d) determining a ratio of pixel counts allocated to the plurality of the same ink nozzle arrays with respect to each line set; (e) determining an average ink ejection amount error for each line set using the ink ejection amount errors for the plurality of same ink nozzle arrays; and (f) correcting ink amount data representing a print image on each main scan line of each line set using the average ink ejection amount error.

Since the ink amount data is calibrated using the average ink ejection amount error for each line set, it is possible to perform ink ejection amount calibration without requiring excessive work even for printers that comprise a printing head unit having a plurality of same ink nozzle arrays.

In one aspect of the present invention, the step (d) may include classifying the line sets into a plurality of line-set types according to the ratio of pixel counts for each line set, and in the step (d) the average ink ejection amount error may be determined with respect to each line set type.

It should be noted that the present invention can be implemented in a variety of embodiments such as, for example, a method and apparatus for calibrating ink ejection amount, a method and apparatus for calibrating a color conversion lookup table, a method and apparatus for calibrating dot recording rate data, a method and apparatus for generating print data, a printer driver, a printing method and printing device, a computer program for implementing the functions of these methods or apparatus, a recording medium on which this computer program is stored, and a data signal embedded in a carrier wave containing this computer program.

These and other objects, features, aspects, and advantages of the present invention will become more apparent from the following detailed description of the preferred embodiments with the accompanying drawings.

BRIEF DESCRIPTION OF THE DRAWINGS

FIGS. 4A and 4B show an example of a 1-line-set type.

FIGS. 5A and 5B show an example of a 2-line-set type.

FIGS. 6A and 6B show an example of a 4-line-set type.

FIGS. 7A and 7B show the ink weight information and the ink calibration value in the first embodiment.

FIG. 10 is a block diagram that shows the structure of the print data generation unit of a second embodiment.

FIGS. 13A and 13B show the ink weight information and the ink calibration value in the second embodiment.

DESCRIPTION OF THE PREFERRED EMBODIMENT

Preferred embodiments of the present invention will be described in the following sequence.

A. First Embodiment:

B. Second Embodiment:

C. Third Embodiment:
D. Variations:

A. First Embodiment

Figure 1:
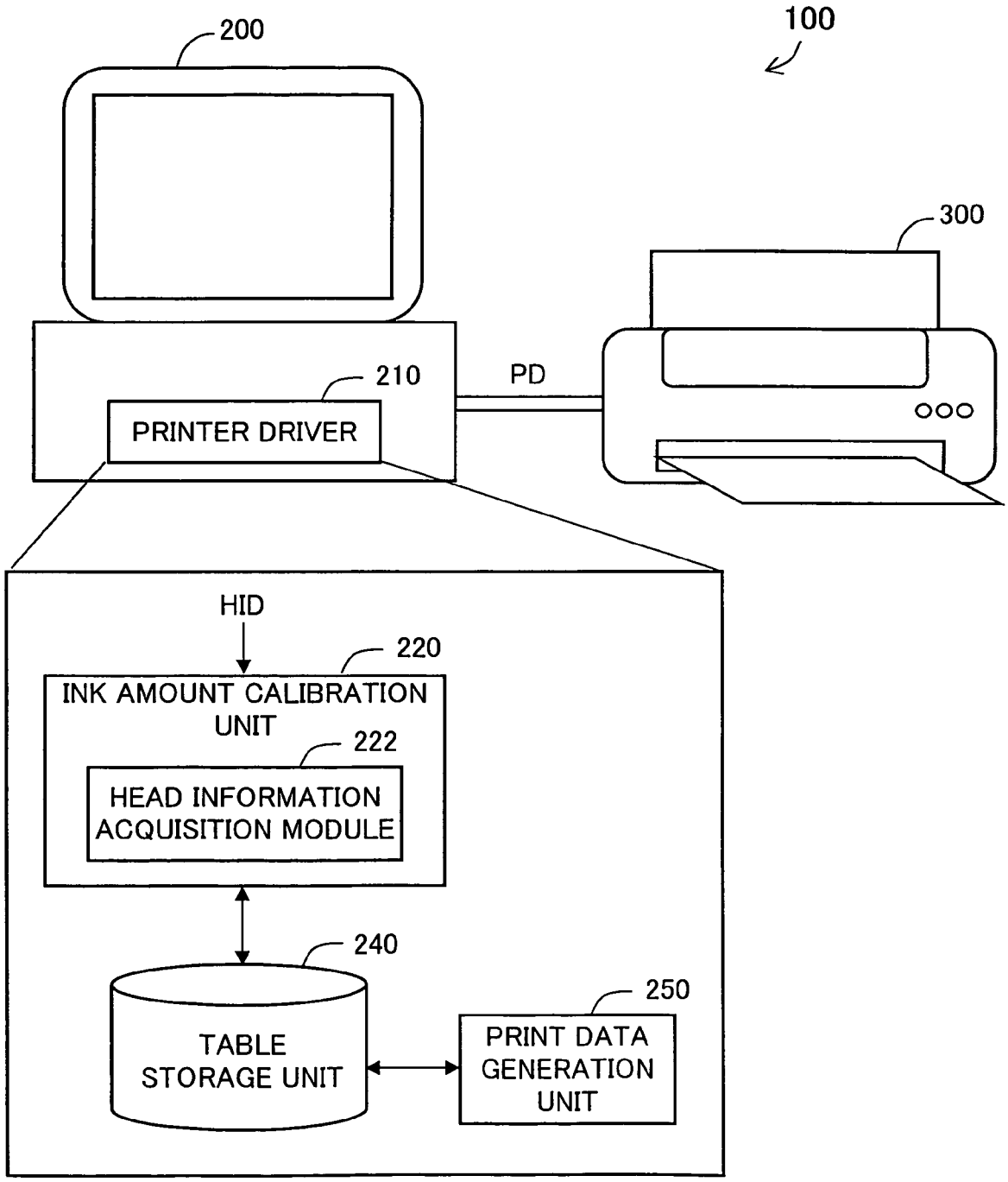
FIG. 1 shows a printing system as a embodiment of the present invention.

FIG. 1 shows a printing system 100 as a first embodiment of the present invention. This system 100 comprises a computer 200 and a color printer 300. The computer 200 comprises a printer driver 210 for generating print data PD to supply to the printer 300.

The printer driver 210 comprises an ink amount calibration unit 220, a table storage unit 240, and a print data generation unit 250. The cable storage unit 240 stores various types of tables including a color conversion lookup table used by the print data generation unit 250. The ink amount calibration unit 220 has a function of correcting or modifying these tables. The table correction is performed based on head information HID relating to the printing head installed in the printer 300. The ink amount calibration unit 220 comprises a head information acquisition module 222 for acquiring the head information HID from the printer 300.

Figure 2:
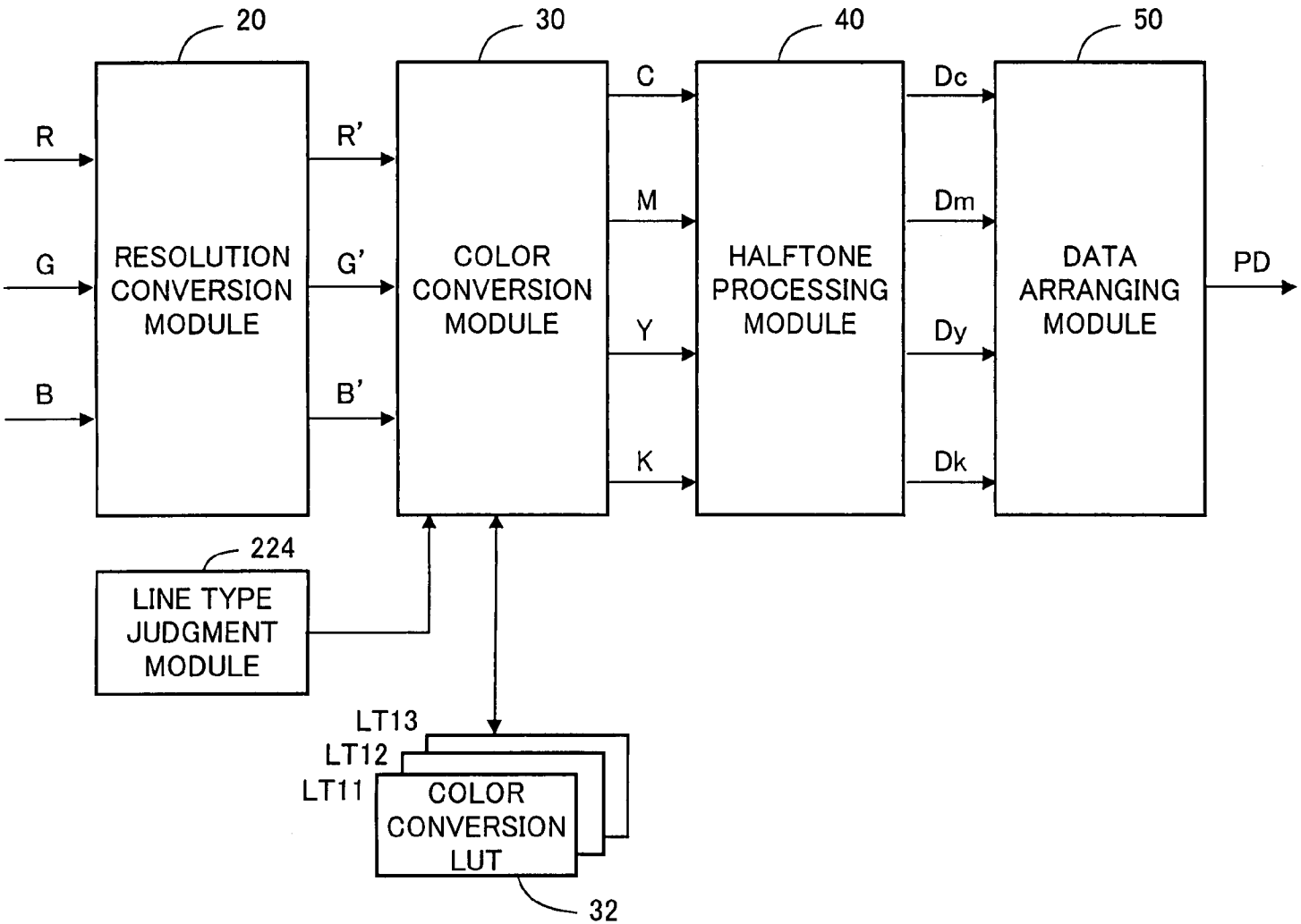
FIG. 2 is a block diagram that shows the structure of a print data generation unit of the first embodiment.

FIG. 2 is a block diagram showing the structure of the print data generation unit 250 in the first embodiment. The print data generation unit 250 comprises a resolution conversion module 20, a color conversion module 30, a halftone processing module 40, and a data arranging module 50. The resolution conversion module 20 converts the resolution of input color image data R, G, and B to a resolution suitable for the process in and after the color conversion module 30. The color conversion module 30 converts the color image data R', G', and B' after the resolution conversion to ink amount data C, M, Y, K using a color conversion lookup table 32. The halftone processing module 40 generates dot forming data Dc, Dm, Dy, and Dk, each of which represents a dot formation state at each printing pixel, by executing halftone processing for each of the inks. The data arranging module 50 arranges these dot formation data Dc, Dm, Dy, and Dk in a suitable order, and outputs them as the print data PD.

In the first embodiment, different color conversion lookup tables 32 are respectively created for respective line set types LT11 to LT13 (to be described later). When creating print data, a line type judgment module 224 judges a type of each main scanning line or raster line, and informs the line type to the color conversion module 30. The line type judgment module 224 is included in the ink amount calibration unit 220 shown in FIG. 1. It is also possible to construct the line type judgment module 224 as an element of the print data generation unit 250.

The printer driver 210 shown in FIG. 1 normally is implemented as a program stored in a storage unit, such as a hard disk, in a computer. The print data PD created by the printer driver is supplied to an external printer. There are also cases when the printer driver is implemented within the printer. In this case, the print data PD created by the printer driver is supplied to a printing unit or printing mechanism within the printer. It should be noted that in the case of a printer driver implemented within a computer as well, it is possible to call the external printer a "printing unit." Therefore, the printer driver typically has a function of generating print data to be supplied to a printing unit based on color image data. It is possible to omit the resolution conversion module 20 or the data arranging module 50 from the printer driver. It is also possible to realize part or all of the printer driver using hardware circuitry.

Figure 3:
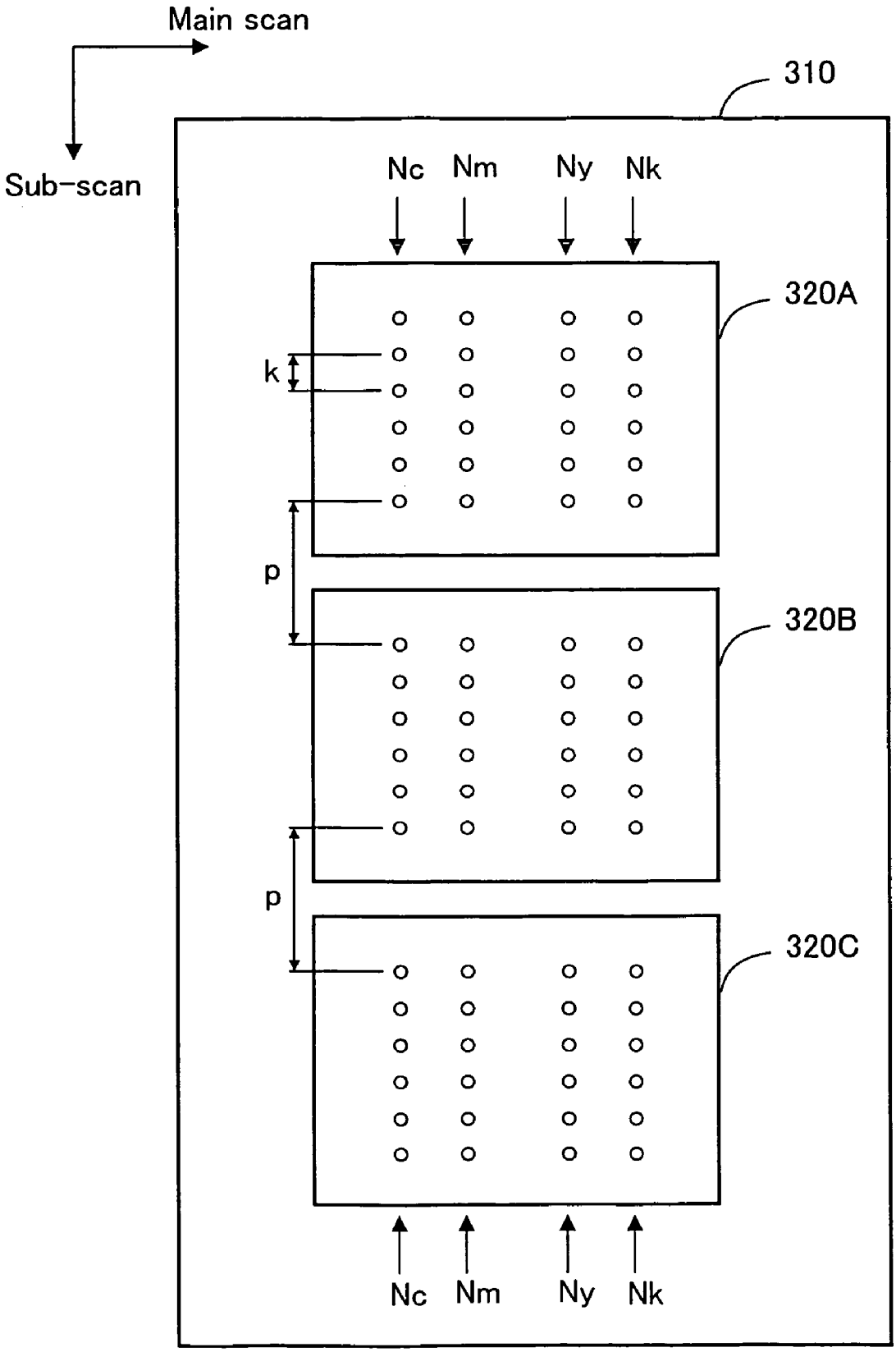
FIG. 3 shows a printing head unit.

FIG. 3 schematically shows the bottom surface of a printing head unit 310 installed in the printer 300. The printing head unit 310 has three printing heads 320A to 320C. These printing heads 320A to 320C are of the same design with the same nozzle arrays, and after being individually manufactured, are assembled onto the printing head unit 310.

The printing head 320A has a cyan ink nozzle array Nc, a magenta ink nozzle array Nm, a yellow ink nozzle array Ny, and a black ink nozzle array Nk. Each of the nozzle arrays Nc, Nm, Ny and Nk is respectively aligned with a fixed pitch k in the sub-scan direction, and has the same nozzle count. The nozzle pitch k is set as an integral multiple of the printing resolution in the sub-scan direction. The four nozzle arrays Nc, Nm, Ny, and Nk within one printing head 320 are positioned along the main scan direction.

The three printing heads 320A to 320C are aligned along the sub-scan direction. The gap p between the adjacent printing head nozzle arrays can be arbitrarily set to a value that is an integral multiple of the printing resolution in the sub-scan direction. It is possible to arrange printing heads 320A to 320C in zigzag fashion to make the gap p smaller. For example, it is possible to make gap p smaller by arranging the second printing head 320B further to the right than the other two printing heads 320A and 320C. Also, as the printing head unit 310, it is possible to use a head unit that has a plurality of printing heads that have mutually different nozzle arrays.

In this embodiment, main scans and sub-scans are executed so that each of the three printing heads 320A to 320C is able to form ink dots of all four inks on each main scan line in an printing area on the printing medium. Also, each print pixel on each main scan line is assigned to one of the three printing heads 320A to 320C, and the printing on each main scan line is always executed using all of the three printing heads 320A to 320C. The reason for this arrangement is that when printing is done using only one of the printing heads, it is easy for so-called banding (stripe shaped image degradation) to occur due to errors in the ink dot landing position. This kind of main scan and sub-scan procedure can be constructed as a main scan and sub-scan with which one of the printing heads (e.g. the head 320A) is able to form ink dots of all the inks on all of the main scan lines in the printing area. Since the three printing heads 320A to 320C have the same nozzle arrays, if the ink dots of all the inks can be formed on all of the main scan lines by one printing head 320A, then the ink dots of all the inks can similarly be formed on all the main scan lines by the other printing heads 320B and 320C as well.

FIGS. 4A, 4B, 5A, 5B, 6A, and 6B show examples of line set types that can be used for ink amount calibration. FIGS. 4A and 4B show an example of 1-line-set type, FIGS. 5A and 5B show an example of 2-line-set type, and FIGS. 6A and 6B show an example of 4-line-set type. The "1-line-set type" means a type of line set when each main scan line is seen as one set of line(s) and classification of main scan lines are executed for each line set (the classification method will be described later). Similarly, the "2-line-set type" means a type of line set when two adjacent main scan lines are seen as one set of lines and the classification of main scan lines are executed for each line set, and the "4-line-set type" means a type of line set when four adjacent main scan lines are seen as one set of lines and the classification of main scan lines are executed for each line set. Generally, it is possible to classify main scan lines while considering N adjacent main scan lines (N is any integer of 1 or greater) as one set of line(s).

FIG. 4B shows the allocation of heads for each of the printing pixels on main scan lines L1 to L12. Here, the eight pixels on each of the main scan lines are shown with a rectangular frame, and the letters A through C within each frame show the printing heads 320A to 320C that are in charge of forming ink dots on those pixels. For example, on the uppermost main scan line L1, ink dots of all the inks are formed by the third printing head 320C at the first pixel, and ink dots of all the inks are formed by the first printing head 320A on the second pixel. It should be noted that it is possible to change the allocation of heads to each pixel with respect to each ink. This case also has the feature that, for each of the inks, each pixel on each main scan line is allocated to one of the three printing heads 320A to 320C. It should be noted that the reference characters A to C allocated to each pixel may also be thought of as showing each pixel classification.

The ratio of pixels allocated to the printing heads 320A to 320C differs for each main scan line. For example, on the first main scan line L1, two out of four pixels are allocated to the first printing head 320A, one pixel is allocated to the second printing head 320B, and one pixel is allocated to the third printing head 320C. Also, on second main scan line L2, one out of four pixels is allocated to the first printing head 320A, two pixels are allocated to the second printing head 320B, and one pixel is allocated to the third printing head 320C. On the third main scan line L3, one out of four pixels is allocated to the first printing head 320A, one pixel is allocated to the second printing head 320B, and two pixels are allocated to the third printing head 320C.

The 1-line-set type LT11 to LT13 shown in FIG. 4A are a result of classification according to the ratio of pixel allocation count to the three printing heads 320A to 320C within each line set when one main scan line is seen as one line set. The first 1-line-set type LT11 is a type with a 2:1:1 ratio of allocated pixel count to the three printing heads 320A, 320B, and 320C. For example, the main scan lines L1 and L4 of FIG. 4B correlate to the first 1-line-set type LT11. The second 1-line-set type LT12 is a type with a 1:2:1 ratio of pixel allocation count. The third 1-line-set type LT13 is a type with a 1:1:2 ratio of pixel allocation count. When pixels are allocated as shown in FIG. 4B, each individual main scan line can be classified as one of the three 1-line-set types LT11 to LT13 as shown in FIG. 4A. Also, with the example in FIG. 4B, the three 1-line-set types LT11 to LT13 appear repeatedly in this order.

Since the three printing heads 320A to 320C are assembled onto one head unit after being individually manufactured, it is possible for there to be quite a difference in the ink ejection amounts of the heads. When the ink ejection amounts of the three printing heads 320A to 320C are different, then the ink ejection amount on the three 1-line-set types LT11 to LT13 will be different. As a result, so-called banding occurs, and the image quality worsens. In light of this, to correct the ink ejection amount discrepancy on the three 1-line-set types LT11 to LT13, the ink amount calibration unit 220 (FIG. 1) creates color conversion lookup tables 32 (FIG. 2) suitable for the 1-line-set types. This process will described later.

FIG. 5A shows the pixel allocation ratio of six 2-line-set types LT21 to LT26. FIG. 5B is the same type of figure as FIG. 4B. The 2-line-set types LT21 to LT26 are a result of classification according to the ratio of pixel allocation count to the three printing heads 320A to 320C for each of the line sets when two adjacent scan lines are seen as one line set. The first 2-line-set type LT21 is a type with a 3:3:2 ratio of the allocated count of pixels to the three printing heads 320A, 320B, and 320C. For example, the 2-line-set (L1+L2) of FIG. 4B correlates to this first 2-line-set type LT21. The same is true for the other 2-line-set types LT22 to LT26. With the example in FIG. 5B, the fourth to sixth 2-line-set types LT24 to LT26 do not appear in the area subject to printing. These 2-line-set types LT24 to LT26 may appear in cases when the pixel allocation method on each of the main scan lines differ from that of FIG. 5B.

As can be understood from the example in FIG. 5B, generally, of all of the line set types that can possibly appear, which type of line set type appears within the area subject to printing depends on the pixel allocation method on each of the main scan lines. Also, the pixel allocation method on each of the main scan lines are respectively selected by the printing mode used for printing. Furthermore, the printing mode is selected according to a plurality of printing parameters including a printing resolution and printing media. Therefore, it is also preferable to execute ink amount calibration according to the printing mode. Specifically, for example when using only the three types of 2-line-set types LT21 to LT23 as shown in the example in FIG. 5B, three color conversion lookup tables 32 (FIG. 2) suitable for these types LT21 to LT23 are to be created, and when the other 2-line-set types LT24 to LT26 are used, three color conversion lookup tables 32 suitable for these types LT24 to LT26 are to be created.

FIG. 6A shows the pixel allocation ratio for the three 4-line-set type LT41 to LT43. FIG. 6B is the same type of figure as FIG. 4B. The 4-line-set types LT41 to LT43 are a result of classification according to the ratio of pixel allocation count to the three printing heads 320A to 320C for each of the line sets when four adjacent scan lines are seen as one line set. The first 4-line-set type LT41 is a type with a 6:5:5 pixel allocation count ratio to the three printing heads 320A, 320B, and 320C. For example, the initial 4-line-set (L1+L2+L3+L4) of FIG. 6B correlates to the first 4-line-set type LT41. The same is also true for the other 2-line-set types LT42 to LT43.

Generally, it is possible to classify main scan lines within the area subject to printing into N line set types each of which is formed by N adjacent main scan lines (where N is any integer of 1 or greater). Also, as shown in the examples of FIGS. 4B, 5B, and 6B, generally, in many cases, a plurality of N line set types within the area subject to printing repeatedly appear in a specific sequence. The value of N, as well as which of the plurality of N line set types which can appear within the area subject to printing actually appears, are determined in advance according to the printing mode. It should be noted that there are cases when one preferable value of N is always used for every printing mode. For example, when the processing of the print data generation unit 250 (especially processing of the color conversion module 30) is performed using two main scan lines, from the perspective of processing speed, it is preferable to set N to either 2 or 4. In other words, typically, it is preferable to set the value of N to an integral multiple of the scan line count that is a unit of processing in the color conversion module 30. However, N=1 is used with the explanation below (the 1-line-set type shown in FIG. 4), and all of the three 1-line-set types LT11 to LT13 within the area subject to printing appear.

FIG. 7A shows the ink weight information for each head. FIG. 7B shows an ink calibration value δ for each of the 1-line-set types. As shown in FIG. 7A, an ink weight information Wc, Wm, Wy, and Wk of the four nozzle arrays C, M, Y, and K is stored in the memory (not illustrated) within the printer 300 respectively for the three printing heads 320A to 320C. Here, the "ink weight information" is a value representing an error from the standard value or design value of each of the nozzle ink ejection amounts. With this example, the ink weight information is a value that displays as a percent the actual ejection amount when the standard ejection amount is 100%. For example, the value of the ink weight information Wc of the cyan nozzle array of the first printing head 320A is 98, so the ejection amount of this cyan nozzle array is smaller than the standard value by 2%. It is preferable to use the average ejection amount of the cyan nozzle array of that printing head as the "cyan nozzle array ejection amount." Each nozzle array ejection amount is respectively determined by a specific ejection test.

It should be noted that as the ink weight information, it is also possible to use information indicative of a correction amount for the ink ejection amount instead of information indicative of the error. As this correction amount, it is possible to use the inverse number 1/W of the ink weight information W noted above, for example. The correction amount information and the ink weight information W have a common feature that they represent the ink ejection amount error.

Each of the 1-line-set type ink calibration value δ shown in FIG. 7B is calculated according to the pixel allocation count ratio for each type. In specific terms, the ink calibration value δc(LT11) to δc(LT13) relating to the cyan nozzle array are respectively calculated by the following formulas.

$$\delta c(LT11)=(Wc(A)*2+Wc(B)+Wc(C))/4 \quad (1a)$$

$$\delta c(LT12)=(Wc(A)+Wc(B)*2+Wc(C))/4 \quad (1b)$$

$$\delta c(LT13)=(Wc(A)+Wc(B)+Wc(C)*2)/4 \quad (1c)$$

Here, Wc(A), Wc(B), and Wc(C) are the cyan ink weight information for the printing heads 320A, 320B, and 320C.

As can be understood from this example, a certain ink calibration value δ is equivalent to the average ejection amount of the ink ejection amount on each 1-line-set. This ink calibration value δ may also be thought of as showing the average error of the ink ejection amount on that 1-line-set. It should be noted that the "average" here is calculated for a case where ink dots are formed on all the pixels on the 1-line-set. In actuality, there are pixels for which ink dots are formed and pixels for which ink dots are not formed, so the actual average ejection amount differs for each main scan line. However, when the actual ink average ejection amount or average error is calculated for each of the main scan lines, a fair amount of processing time is required. In contrast to this, as shown with this embodiment, if the average ejection amount for a case where ink dots are formed on all pixels of a 1-line-set is used as the ink calibration value δ, it is possible to calibrate the ink ejection amount without requiring excessive processing time.

As shown in FIG. 7B, the ink calibration value δ is calculated for each of the inks of each of the 1-line-set types. Then, using these ink calibration values δ, a color conversion lookup table 32 (FIG. 2) is created for each 1-line-set type. It should be noted that with FIG. 7B, the value of the calibration value δ is noted up to two digits below the decimal point, but it is possible to perform a rounding operation as necessary, for example, to round to an integral value.

Figure 8:
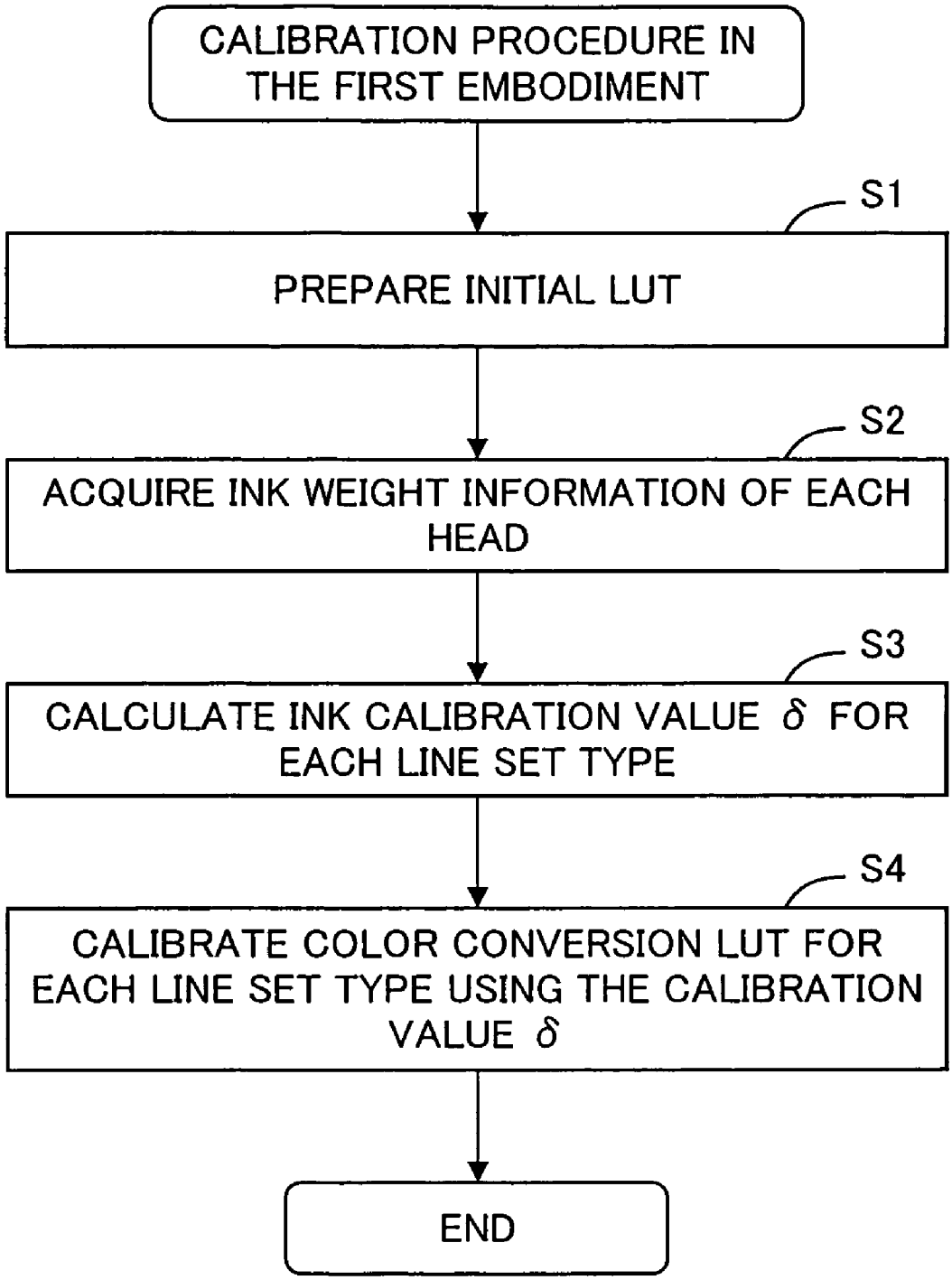
FIG. 8 is the procedure of calibrating the ink ejection amount in the first embodiment.

FIG. 8 is a flow chart showing the procedure for calibrating ink ejection amount in the first embodiment. In step S1, a pre-calibration color conversion lookup table or initial LUT is prepared. Normally, initial LUTs are respectively prepared in advance suited for each of the plurality of printing modes, and these are stored in the table storage unit 240 (FIG. 1). Therefore, in step S1, the ink amount calibration unit 220 selects one initial LUT suited for the printing mode to be used.

In step S2, the head information acquisition module 222 acquires the ink weight information W (FIG. 7A) of each printing head from the printer 300. In step S3, the ink amount calibration unit 220 uses the ink weight information W and calculates the calibration value δ of each ink for each of the line set types. In step S4, the ink amount calibration unit 220 creates a color conversion lookup table 32 (FIG. 2) for each line-set-type by correcting the output of the initial LUT using these ink calibration values δ. In specific terms, the calibrated ink amount data C', M', Y', and K' is calculated by correcting the ink amount data C, M, Y, and K which are the output of the initial LUT, according to the following equations, for example.

$$C'=C/\delta c \quad (2a)$$

$$M'=M/\delta m \quad (2b)$$

$$Y'=Y/\delta y \quad (2c)$$

$$K'=K/\delta k \quad (2d)$$

Specifically, the calibrated ink amount data C', M', Y', and K' may be obtained by dividing pre-calibration ink amount data C, M, Y, and K by the respective ink calibration values δ. It is possible to use a value δ' that is equal to an inverse number 1/δ of the calibration value δ described above. At this time, calibration is performed by multiplying the calibration value δ' with the pre-calibration ink amount data C, M, Y, and K.

It should be noted that the procedure for calibrating ink amount shown in FIG. 8 may be executed at any timing. For example, when the printer driver 210 is installed into a computer, it is possible to perform calibration of the ink amount for all the printing modes to be used with the printer 300, and to create all the color conversion lookup tables for each of the printing modes. By doing so, it is possible to perform actual printing without doing the process of creating a color conversion lookup table, so there is the advantage of being able to shorten each individual printing time. It is also possible to perform the ink amount calibration for a printing mode when executing printing in the particular printing mode for the first time with the printer 300.

Figure 9:
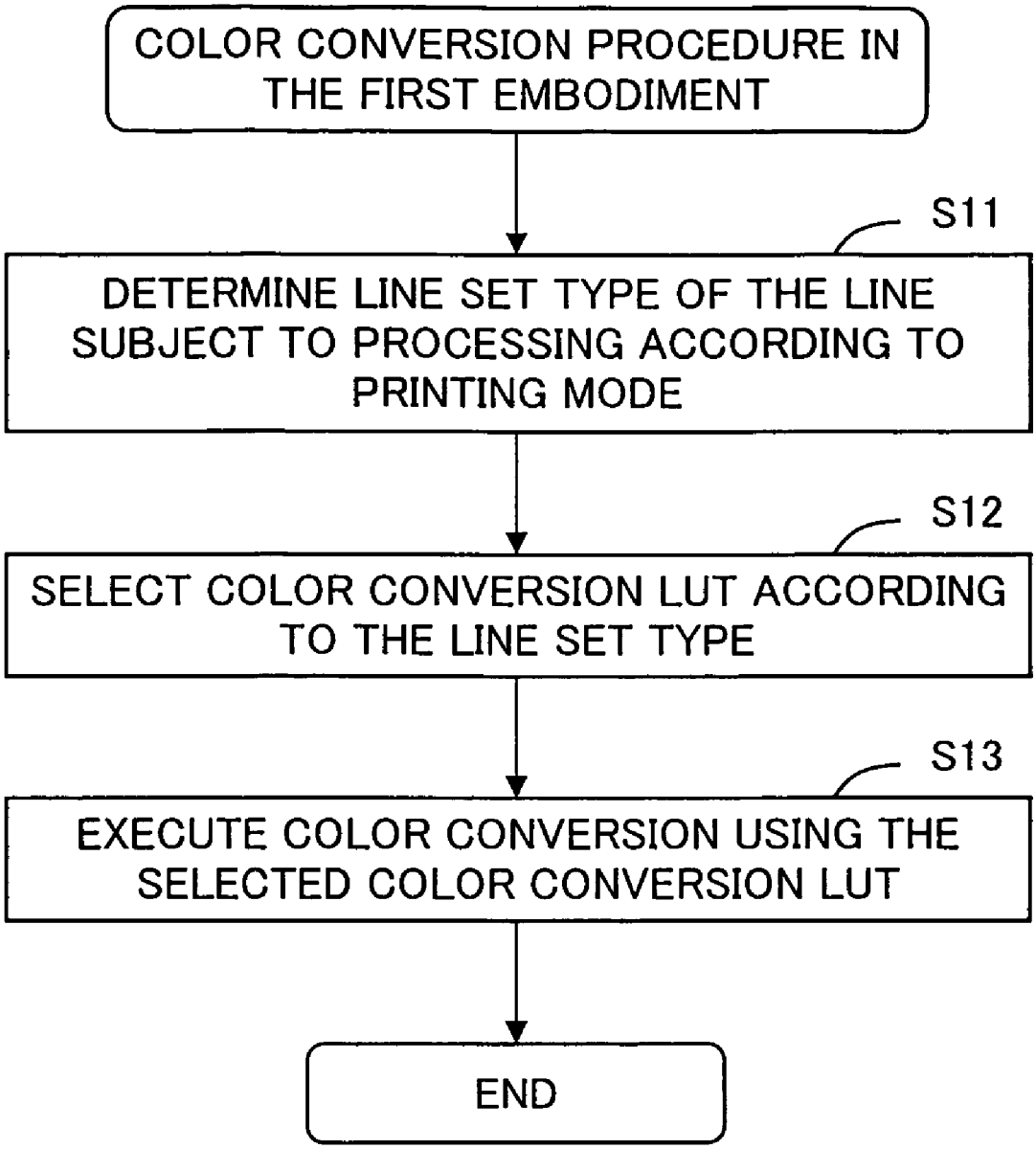
FIG. 9 is a flow chart that shows the procedure for calibrating the ink ejection amount in the first embodiment.

FIG. 9 is a flow chart that shows the color conversion procedure during creation of print data. In step S11, the line type judgment module 224 (FIG. 2) determines the line-set type of main scan line that is subject to processing according to the used printing mode. For example, when using the three 1-line-set types LT11 to LT13 shown in FIG. 4A, a determination is made of which of these three types LT11 to LT13 the line subject to color conversion processing is. Normally, it is possible to identify what line-set type each of the main scan lines within the printing subject range is (type identification such as in FIG. 4B) when the printing mode and the printing area on a printing medium (blank space, etc.) is set. Therefore, the line type judgment module 224 is able to determine the line set type according to which number line from the start the main scan that is subject to processing by color conversion module 30 is. The function of the line type judgment module 224 may be realized by the color conversion module 30 instead.

In step S12, the color conversion module 30 selects one of a plurality of color conversion lookup tables according to the type of line subject to processing. In step S13, using the selected color conversion lookup table, the color image data R', G', and B' are converted to the ink amount data C, M, Y, and K.

As described above, with the first embodiment, the main scan lines are classified in advance into a plurality of line set types, and color conversion is executed using color conversion lookup tables calibrated according to respective line-set types, so it is possible to execute printing with an ink amount that is suitable to each main scan line type. Also, the ink calibration value is determined by correcting ink amount data according to the pixel count ratio that each printing head is in charge of recording for each of the line set types, so it is possible to perform calibration of ink ejection amount relatively easily without requiring excess processing time.

B. Second Embodiment

FIG. 10 is a block diagram that shows the structure of the print data generation unit 250*a* in a second embodiment. There are two differences from the first embodiment shown in FIG. 2: the first difference is that a dot recording rate conversion module 60 is added between the color conversion module 30 and the halftone processing module 40, and the second difference is that instead of the color conversion LUTs 32, dot recording rate tables 62 are used as the tables suitable for respective line set types.

Figure 11A:
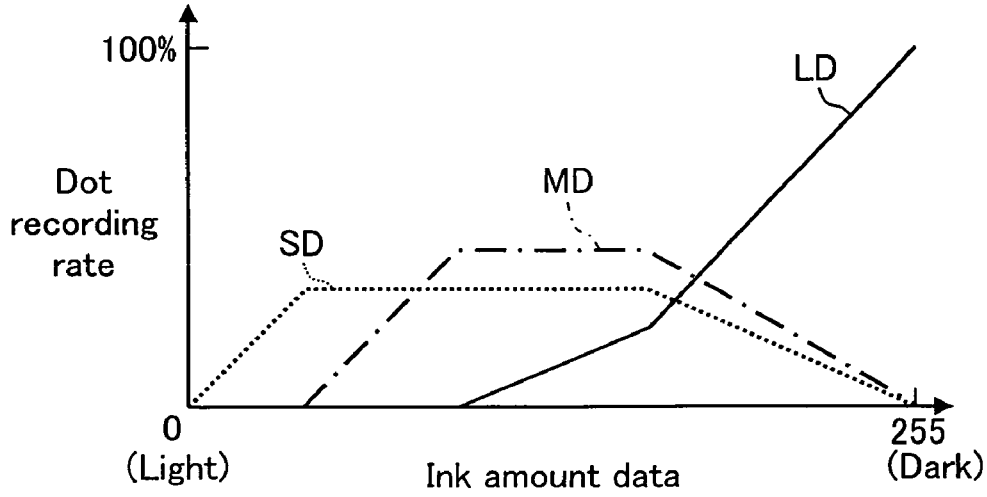
FIGS. 11A and 11B show a method of calibrating a dot recording rate table in the second embodiment.

FIG. 11A shows the conversion characteristics of the dot recording rate table 62. The horizontal axis is the ink amount data as input, and the vertical axis is the dot recording rate as output. Specifically, the dot recording rate table 62 has ink amount data as input, and has the dot recording rate relating to three types of dots of small dots SD, medium dots MD, and large dots LD as the output. The "dot recording rate" of a certain dot means the probability of recording that dot on a pixel. For example, a dot recording rate of 100% for a large dot LD means that large dots LD will be recorded on all pixels, and a dot recording rate of 50% means that large dots LD will be recorded on half of the pixels. However, whether or not dots will be formed on each pixel is determined by the halftone processing of the dot recording rate. For the pre-calibration dot recording rate table or initial table, a single table common to all inks may be used. As explained hereafter, in the second embodiment, the initial table is calibrated for each line set type, thereby creating a dot recording rate table 62 for each line set type.

Figure 12:
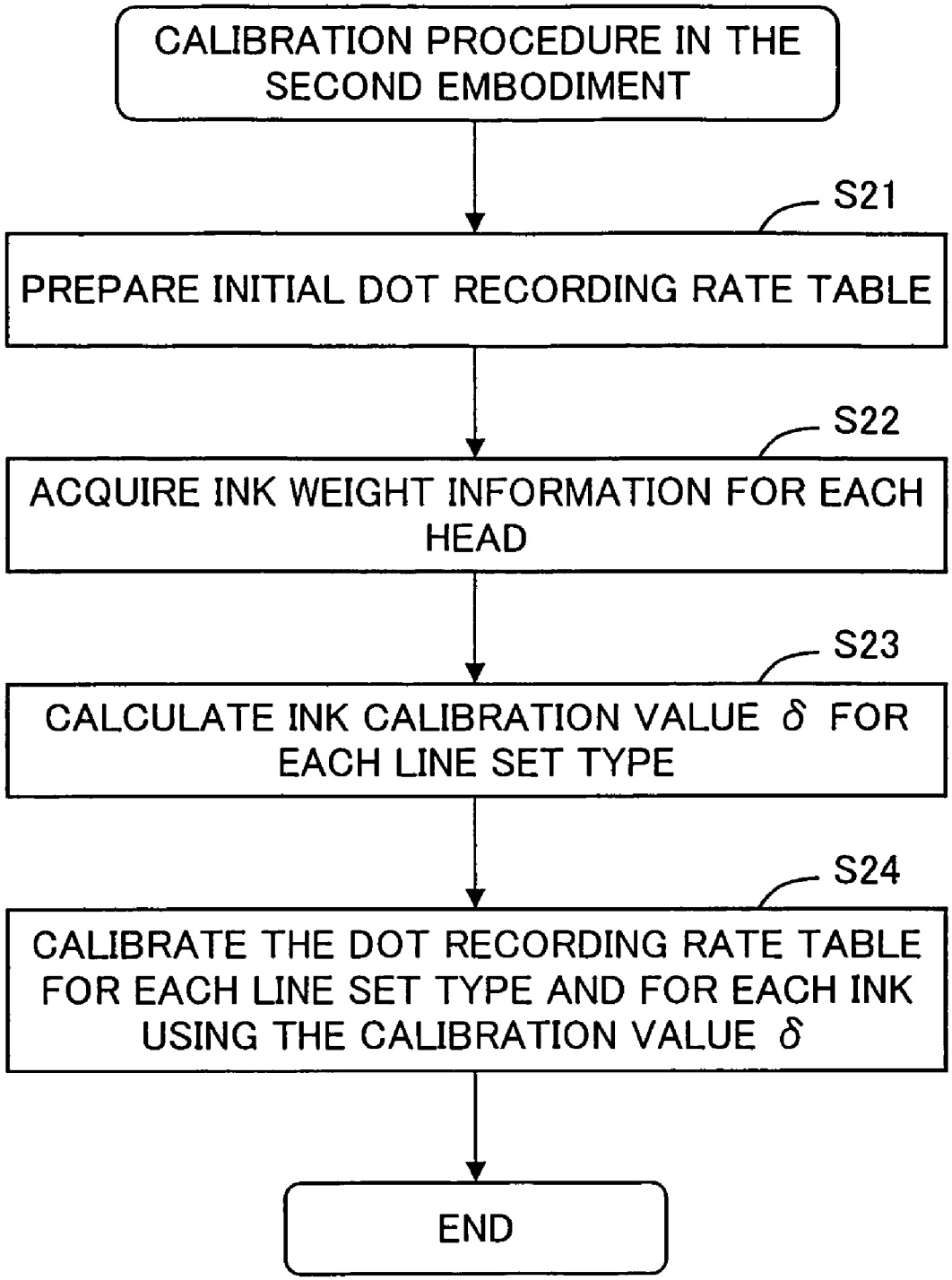
FIG. 12 is a flow chart that shows a procedure for calibrating the ink ejection amount in the second embodiment.

FIG. 12 is a flow chart that shows the procedure for calibrating the ink ejection amount in the second embodiment, corresponding to FIG. 8 in the first embodiment. In step S21, a pre-calibration dot recording rate table or initial table is prepared. Normally, initial tables respectively suitable for the plurality of printing modes are prepared in advance, and these are stored in the table storage unit 240 (FIG. 1). Therefore, In step S21, the ink amount calibration unit 220 selects one initial table that is suitable for the printing mode to be used.

In step S22, the head information acquisition module 222 (FIG. 1) acquires the ink weight information W (FIG. 7A) of each print head. FIG. 13A shows the ink weight information W used in the second embodiment. When calibrating the dot recording rate table, the ink weight information W of each dot size for each ink is acquired for each of the printing heads. For convenience of illustration in FIG. 13A, only the ink weight information Wc(S), Wc(M), and Wc(L) relating to cyan ink are shown. These letters S, M, and L in parentheses respectively mean small dots, medium dots, and large dots.

In step S23, the ink amount calibration unit 220 calculates the calibration value δ of each dot size for each ink for each of the line set types. FIG. 13B shows the calibration values δc for cyan ink. As is the case with the first embodiment, each calibration value is calculated according to the ratio of pixel counts allocated to respective print heads for each line set type. It should be noted that a calibration value δ is calculated respectively for each dot size in the second embodiment.

Figure 11B:
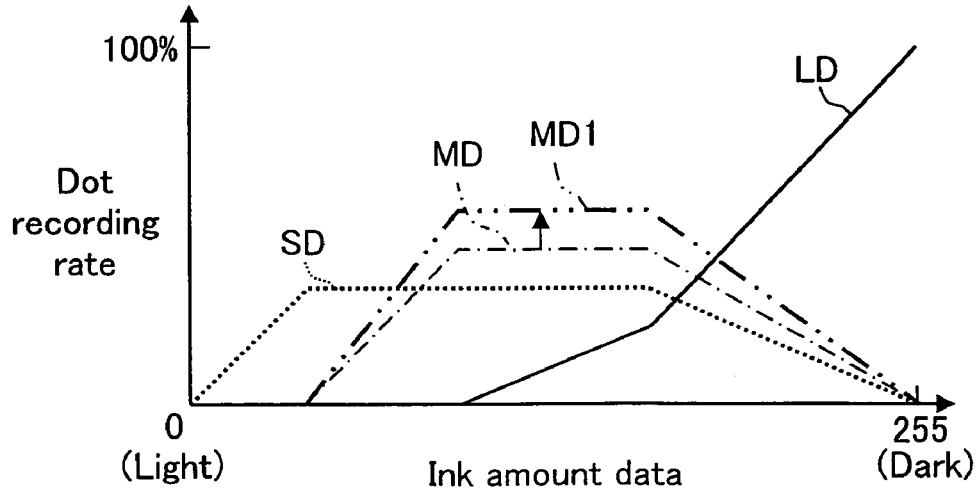

In step S24 in FIG. 12, the ink amount calibration unit 220 creates the calibrated dot recording rate table 62 (FIG. 10) by correcting the output of the initial tables using the ink calibration value δ. FIG. 11B shows an example of a method of calibrating a dot recording rate table. In this example, only the dot recording rate MD of the medium dot is corrected. When the calibration value of the medium dots is 101%, for example, the original dot recording rate of the medium dot is multiplied by 1/1.01 to thereby obtain a calibrated dot recording rate MD1. The same is true for small dot and large dot as well. The calibration of the dot recording rate table is performed for each line set type and each ink. FIG. 10 is illustrated such that the dot recording rate table for one line set type includes tables for all four inks. However, it is also possible to separate dot recording rate tables for each ink for one line set type. The calibrated dot recording rate tables created in this way are selected and used according to the type of the main scan line that is subject to processing when creating print data.

As described above, in the second embodiment, the ink ejection amount is calibrated by correcting the dot recording rate that is the output of the dot recording rate table, so even when the ink ejection amount error is different for each of the dot sizes, it is possible to perform suitable calibration for each of the dot sizes. Moreover, even for the print data generation unit 250*a* of the second embodiment, it is possible to perform calibration of the ink ejection amount by correcting the color conversion lookup table instead of the dot recording rate table.

The dot recording rate can be thought of as the ink amount data for each dot size. Meanwhile, each of the outputs C, M, Y, and K of the color conversion lookup table 32 is equivalent to the summation of the ink amount data for the plural dot sizes for each ink. As can be understood from this explanation, in this specification, the term "ink amount data" is used as a term that has a broad meaning that includes not only the ink amount data (narrow definition of ink amount data) that is the output of the color conversion lookup table 32, but also the dot recording rate that is the output of the dot recording rate table 62.

C. Third Embodiment

FIG. 14 shows a method for correcting the dot recording rate table in a third embodiment. The third embodiment only differs from the second embodiment in regards to this correction method, and the rest of the structure is the same as the second embodiment.

Figure 14A:
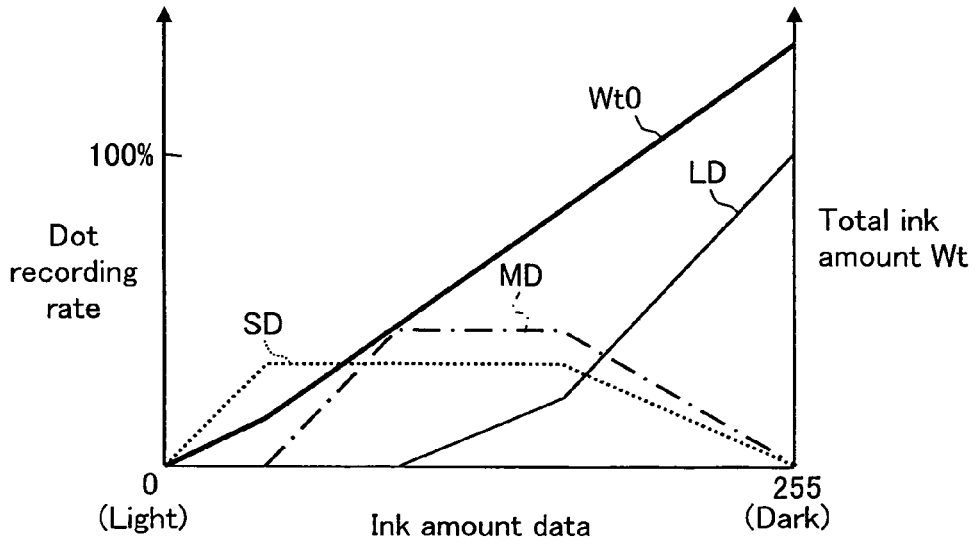
FIGS. 14A and 14B show the method of calibrating a dot recording rate table for a third embodiment.

The small dot SD, medium dot MD, and large dot LD conversion characteristics shown in FIG. 14A are the same as those shown in FIG. 11A. In FIG. 14A, the total ink amount Wt0 of the three types of dots are also depicted. The total ink amount Wt0 is obtained by adding the standard ink weights Wref(S), Wref(M), and Wref(L) of respective dot sizes multiplied by the dot recording rates SD, MD, and LD, according to the following equation.

$$Wt0=Wref(S)\times SD+Wref(M)\times MD+Wref(L)\times LD \quad (3)$$

Figure 14B:
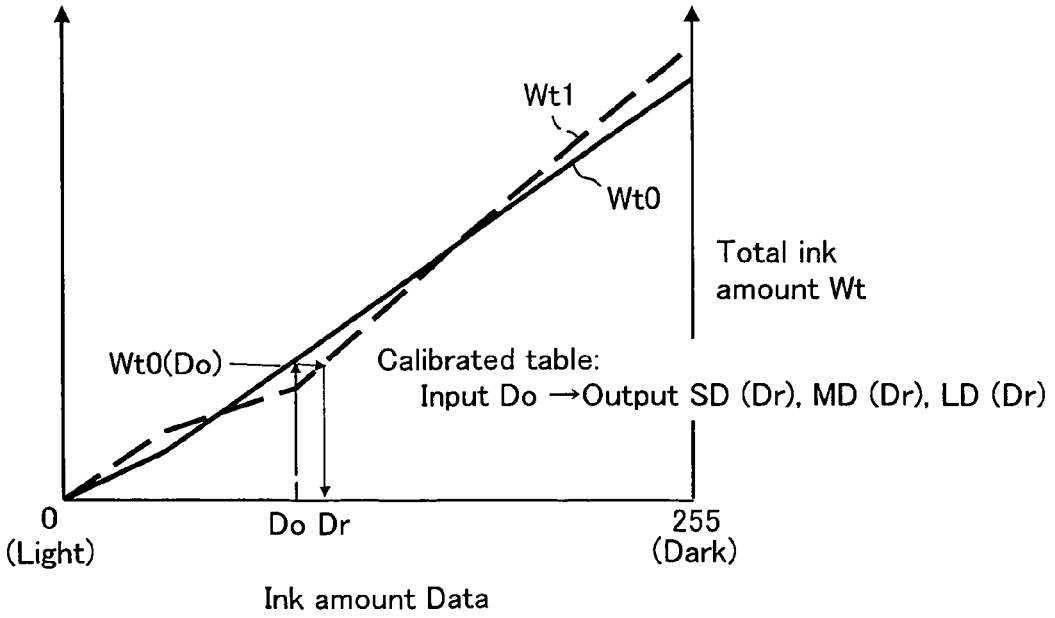

FIG. 14B shows the method of correcting a table using the total ink amount. First, using the ink calibration values δ (FIG. 13B), the calibrated total ink amount Wt1 is calculated. For example, the total ink amount Wt1 of the line set type LT11 is calculated using the following equation.

$$Wt1 = \delta c(S, LT11) \times Wref(S) \times SD + \delta c(M, LT11) \times Wref(M) \times MD + \delta c(L, LT11) \times Wref(L) \times LD \quad (4)$$

Here, δc(S, LT11), δc(M, LT11), and δc(L, LT11) denote calibration valued for the cyan ink small dot, medium dot, and large dot for the line set type LT11.

The correction of the dot recording rate table is performed as described below using the curves of the two total ink amounts Wt0 and Wt1. For example, in the graph of FIG. 14B, the initial total ink amount Wt0(Do) is obtained for a certain input value Do, and an input value Dr that has this same value Wt0(Do) is found from the graph of the calibrated ink amount Wt1. Then, this input value Dr is input to the initial dot recording rate table, and each size dot recording rate SD(Dr), MD(Dr), and LD(Dr) is acquired. The calibrated dot recording rate table is created so that the dot recording rates SD(Dr), MD(Dr), and LD(Dr) are output responsive to the input value Do. In more concrete terms, the initial table outputs SD(Do), MD(Do), and LD(Do) for the input value Do are replaced by the initial table outputs SD(Dr), MD(Dr), and LD(Dr) for the input value Dr. Therefore, when the input value Do is input to the calibrated dot recording table, dot recording rates SD(Dr), MD(Dr), and LD(Dr) that give a suitable total ink amount Wt0(Do) are output. This kind of table correction is performed for each of the input values of the initial table.

As can be understood from the second and third embodiments, it is possible to use various methods that substantially calibrate the ink ejection amount as the method of calibrating the dot recording rate table.

D. Variations:

D1. Variation 1:

In the embodiments noted above, tables suitable for the line set types (color conversion lookup tables or dot recording rate tables) are created, but instead of these, it is also possible to provide a correction module for correcting the table output. For example, in the first embodiment, a correction module may be provided between the color conversion module 30 and the halftone processing module 40 in FIG. 2 so that ink amounts are calibrated by correcting the ink amount data C, M, Y, and K output from the color conversion module 30.

D2. Variation 2:

In the embodiments described above, it is assumed that all of the print heads of the printing head unit are used in formation of ink dots on each main scan line in the printing area, but the present invention is applicable to cases where dot formation of a certain ink (called "the same ink") on at least some main scan lines in the printing area is performed using a plurality of nozzle arrays. Here, "a plurality of nozzle arrays" may be provided on different printing heads as in the embodiment described above, or may also be provided on the same printing head. The plurality of nozzle arrays provided on the same printing head are preferably ones that eject identical ink, and that have different errors of the ink ejection amount.

Figure 15:
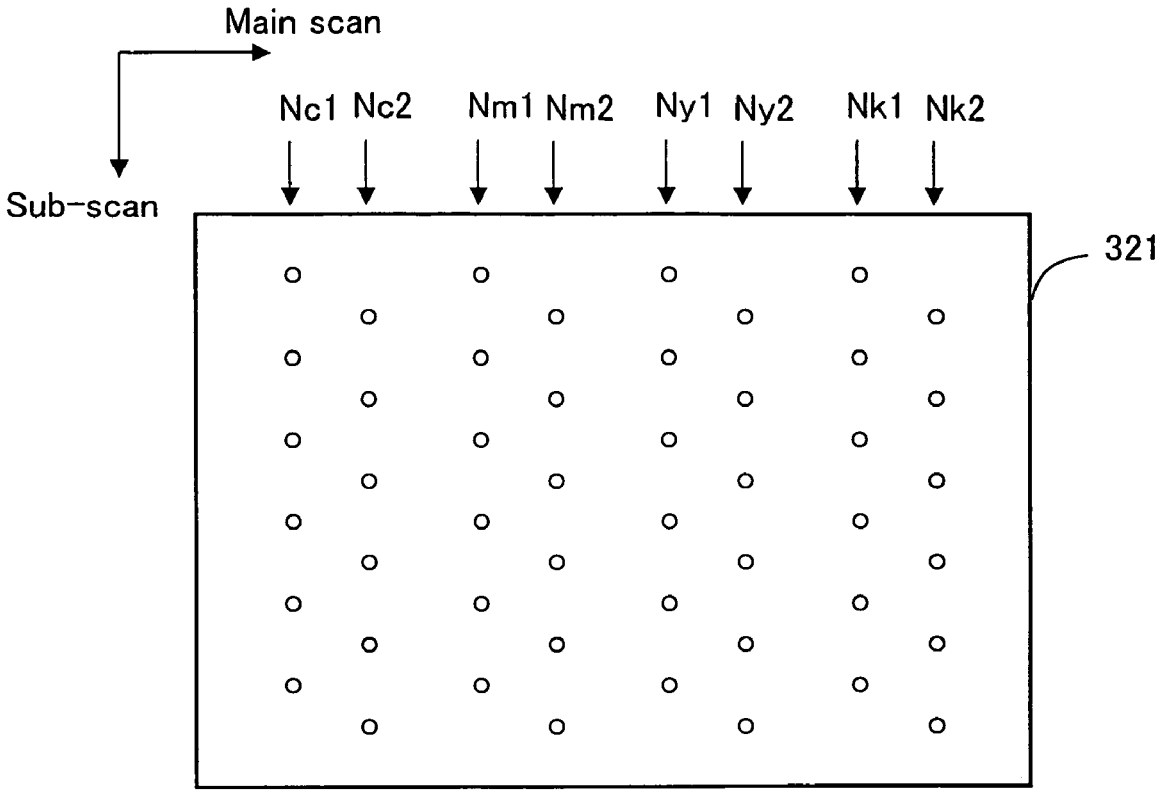
FIG. 15 shows a variation example of the printing head.

FIG. 15 shows an example of a print head 321 that has two nozzle arrays for each of the inks. This print head 321 has two nozzle arrays Nc1 and Nc2 for cyan, two nozzle arrays Nm1 and Nm2 for magenta, two nozzle arrays Ny1 and Ny2 for yellow, and two nozzle arrays NK1, NK2 for black. The two nozzle arrays for each ink are arranged in zigzag in the sub-scan direction. For a printer that comprises a print head unit that has only one of this kind of printing head 321, it is possible to respectively obtain the ink weight information or ink ejection amount error for each of the eight nozzle arrays. In this case, if the ink ejection amount errors for the two nozzle arrays Nc1 and Nc2 for cyan ink are different, it is preferable to calibrate the ink amount in the same manner as with the embodiments described above. Alternatively, for the print head of FIG. 15, it is also possible to obtain one ink weight information for two nozzle arrays (e.g. Nc1 and Nc2) that eject the same ink. In this case, it is possible to think of the printing head 321 of FIG. 15 has having the four nozzle arrays for four types of ink, so in terms of this point, this corresponds to one print head 320A shown in FIG. 3.

When a print head unit 310 is assembled using a plurality of print heads manufactured independently as shown in FIG. 3, the ink ejection amount errors for the individual print heads tend to cause a problem. Therefore, the present invention has a marked effect especially when applied to printers that comprise a print head unit having a plurality of print heads.

D3. Variation 3:

In the embodiments noted above, the four types of ink of C, M, Y, and K are used, but it is also possible to use any combination of inks other than the four inks. For example, in addition to cyan ink and magenta ink, it is also possible to use light cyan ink (relatively low density cyan ink) and light magenta ink (relatively low density magenta ink).

D4. Variation 4:

Although ink dots of three different sizes of large, medium, and small are available in the second and third embodiments noted above, the number of ink sizes is not limited to this, and the present invention is applicable to a case where a plurality of ink dots of different sizes are available.

D5. Variation 5:

Although main scan lines are classified into predetermined line set types in the above embodiments, the classification into line set types are not essential to the present invention. For example, main scan lines on a print medium may be simply divided in units of a predetermined number of adjacent lines to identify line sets, and an average ink ejection error of each line set may be calculated based on a ratio of the number of pixels allocated to the same ink nozzle arrays and on an ink ejection error for each of the same ink nozzle arrays. This method is simple in structure than the above embodiments, but the classification into line set types will need less processing time.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of calibrating ink amount for a printer that comprises a printing head unit having a plurality of same ink nozzle arrays for ejecting same ink to form ink dots on a printing medium while scanning the printing head unit in a main scanning direction, the method comprising:

(a) obtaining an ink ejection amount error for each of the plurality of the same ink nozzle arrays;

(b) identifying line sets on the printing medium, each line set consisting of a predetermined number of main scan lines that are adjacent to each other;

(c) allocating pixels included in each line set to the plurality of the same ink nozzle arrays for recording;

(d) determining a ratio of pixel counts allocated to the plurality of the same ink nozzle arrays with respect to each line set;

(e) determining an average ink ejection amount error for each line set using the ink ejection amount errors for the plurality of same ink nozzle arrays; and (f) correcting ink amount data representing a print image on each main scan line of each line set using the average ink ejection amount error.

2. A method claimed in claim 1, wherein the step (d) includes classifying the line sets into a plurality of line-set types according to the ratio of pixel counts for each line set, and in the step (d) the average ink ejection amount error is determined with respect to each line set type.

3. A method claimed in claim 1, wherein the printing head unit includes a plurality of print heads each having one of the plurality of same ink nozzle arrays, and the ink ejection amount error for each same ink nozzle array is preset for each of the print heads.

4. A method claimed in claim 2, wherein the step (f) includes:

(i) providing a color conversion lookup table for converting color image data to ink amount data suitable for the printer; and (ii) correcting the ink amount data output from the color conversion lookup table using the average ink ejection amount error for each line set.

5. A method claimed in claim 4, wherein the step (ii) includes:

generating a type-specific color conversion lookup table for each line set type by correcting the color conversion lookup table using the average ink ejection amount error for each line set type; and obtaining the ink amount data on each main scan line in each line set by selecting and using one of the type-specific color conversion lookup tables according to the line set type of each line set.

6. A method claimed in claim 2, wherein each of the plurality of same ink nozzle arrays is capable of recording dots with a plurality of ink dot sizes, and the step (f) includes:

(i) providing a color conversion lookup table for converting color image data to first ink amount data suitable for printer;

(ii) providing a dot recording rate table that receives the first ink amount data as input, and that outputs a plurality of second ink amount data each representing a recording rate of each ink dot size; and (iii) correcting the plurality of second ink amount data output from the dot recording rate table using the average ink ejection amount error for each line set.

7. A method claimed in claim 6, wherein this step (iii) includes:

generating a type-specific dot recording rate table for each line set type by correcting the dot recording rate table using the average ink ejection amount error for each line set type, obtaining the second ink amount data on each main scan line in each line set by selecting and using one of the type-specific dot recording rate table according to the line set type of each line set.

8. A printer driver for generating print data for a printer that forms ink dots on a printing medium while scanning a printing head unit having a plurality of same ink nozzle arrays for ejecting same ink along a main scan direction, the printer driver comprising:

a print data generation module configured to generate print data based on color image data; and an ink amount calibration module configured to calibrate ink amount data that is used within the print data generation module, wherein the ink amount calibration module includes:

means for obtaining an ink ejection amount error for each of the plurality of the same ink nozzle arrays;

means for identifying line sets on the printing medium, each line set consisting of a predetermined number of main scan lines that are adjacent to each other;

means for allocating pixels included in each line set to the plurality of the same ink nozzle arrays for recording;

means for determining a ratio of pixel counts allocated to the plurality of the same ink nozzle arrays with respect to each line set;

means for determining an average ink ejection amount error for each line set using the ink ejection amount errors for the plurality of same ink nozzle arrays; and means for correcting ink amount data representing a print image on each main scan line of each line set using the average ink ejection amount error.

9. A printing device for forming ink dots on a printing medium while scanning a printing head unit having a plurality of same ink nozzle arrays for ejecting same ink along a main scan direction, the device comprising:

a print data generation module configured to generate print data based on color image data; and an ink amount calibration module configured to calibrate ink amount data that is used within the print data generation module, wherein the ink amount calibration module includes:

means for obtaining an ink ejection amount error for each of the plurality of the same ink nozzle arrays;

means for identifying line sets on the printing medium, each line set consisting of a predetermined number of main scan lines that are adjacent to each other;

means for allocating pixels included in each line set to the plurality of the same ink nozzle arrays for recording;

means for determining a ratio of pixel counts allocated to the plurality of the same ink nozzle arrays with respect to each line set;

means for determining an average ink ejection amount error for each line set using the ink ejection amount errors for the plurality of same ink nozzle arrays; and means for correcting ink amount data representing a print image on each main scan line of each line set using the average ink ejection amount error.

* * * * *